United States Patent [19]

Nakamura

[11] 3,944,282

[45] Mar. 16, 1976

[54] ARTICLE OF FURNITURE FORMED BY INTERCONNECTED STRUCTURAL BODIES

[75] Inventor: Tsugio Nakamura, Funabashi, Japan

[73] Assignee: Sekisui Kagaku Kogyo Kabushiki Kaisha, Osaka, Japan

[22] Filed: Aug. 30, 1974

[21] Appl. No.: 501,859

[30] Foreign Application Priority Data

Aug. 30, 1973 Japan ..... 48-102420[U]

[52] U.S. Cl. ..... 297/440

[51] Int. Cl.[2] ..... A47C 7/00

[58] Field of Search ..... 297/440, 456; 160/229; 312/111; 248/167; 52/108; 16/176

[56] References Cited

UNITED STATES PATENTS

| | | | |
|---|---|---|---|
| 479,448 | 7/1892 | McKay | 160/229 R |
| 638,030 | 11/1899 | Schmitt | 160/229 R |
| 2,494,001 | 1/1950 | Rowe | 160/229 R X |
| 2,644,553 | 7/1953 | Cushman | 160/229 R |
| 2,798,538 | 7/1957 | Dreifke | 297/440 X |
| 2,893,483 | 7/1959 | Holdeman et al. | 160/229 R X |
| 3,673,636 | 7/1972 | Ruiz | 16/176 X |
| 3,706,473 | 12/1972 | Mullen | 297/440 X |

*Primary Examiner*—James C. Mitchell

*Attorney, Agent, or Firm*—Sughrue, Rothwell, Mion, Zinn & Macpeak

[57] ABSTRACT

An article of furniture is formed by a plurality of structural members connected to one another. Each of the structural members comprises an angulated barrel-shaped frame body consisting of a pair of spaced, opposed frame plates which narrow in width from the central portion towards the opposite ends thereof, and another pair of opposed frame plates of constant width over the entire length thereof. Wall plates cover the frame body. A plurality of such structural members are connected with one another by the aid of connecting members disposed substantially in the central portion of the structural member to form furniture such as sofas, desks, beds, tables, etc.

8 Claims, 10 Drawing Figures

FIG. 4
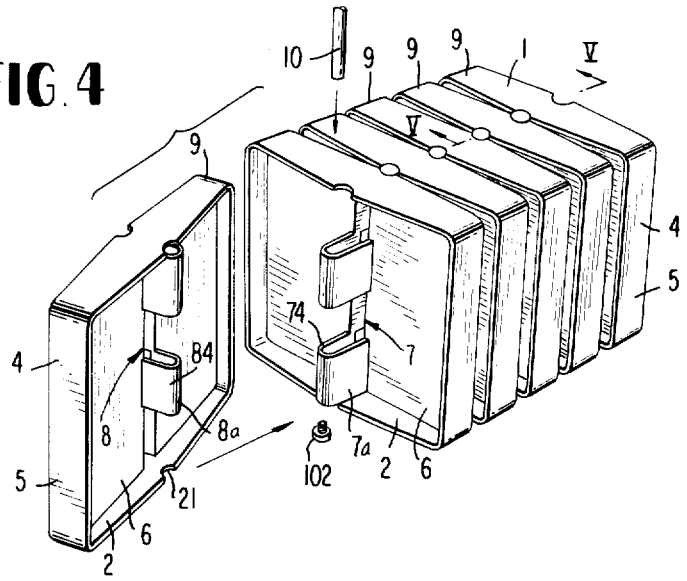
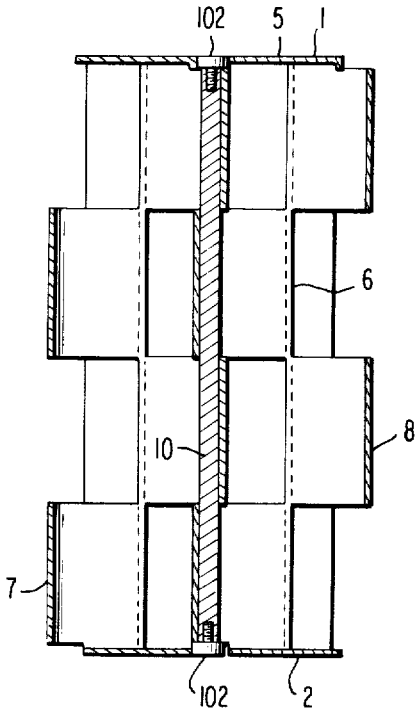
FIG. 5
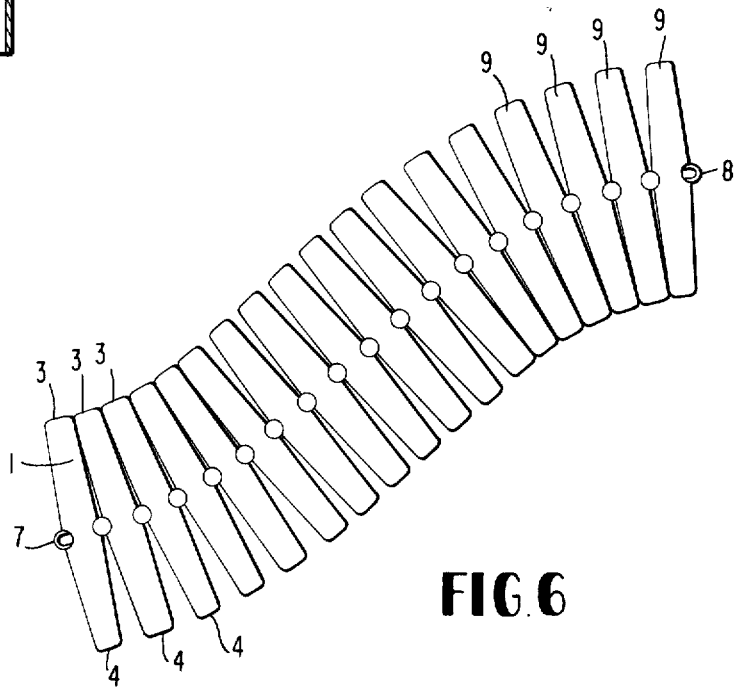
FIG. 6

ARTICLE OF FURNITURE FORMED BY INTERCONNECTED STRUCTURAL BODIES

BACKGROUND OF THE INVENTION

1. Field of the Invention

This invention relates to articles of furniture of structural members having the same shape and connected to one another, and suited for use with chairs, sofas, desks, tables, etc.

2. Description of the Prior Art

Heretofore, furniture of this kind is disclosed in Japanese Utility Model Publication No. 35051/72 in which a plurality of structural elements of cylindrical or polygonal shape are banded together by means of banding or fittings or such structural elements are detachably connected to one another by means of connecting fittings fixed on the exterior surface of the elements so as to provide furniture components usable with chairs, beds, etc.

However, the shape of conventional furniture as described above remains unchanged after a plurality of structural elements have been connected and assembled and possess the disadvantage that the shape of the furniture may not be changed when in its connected condition.

SUMMARY OF THE INVENTION

The present invention overcomes the limitation noted above with respect to prior art furniture and has as its object, to provide furniture components wherein the shape of the furniture may be changed in the state where a plurality of structural members are connected and assembled.

The present invention essentially provides an article of furniture comprising an angulated barrel-shaped frame body consisting of a pair of spaced opposed frame plates each being narrowed in width from the central portion toward the opposite ends thereof and another pair of spaced, opposed frame plates, joined thereto and forming an open rectangular frame, each being of constant width over the entire length thereof, said frame body being integrally connected to the peripheral edges of wall plates overlying the open ends interengaging with said wall plates and having cooperating connectors formed substantially in the central portion of said wall plate. A plurality of said structural members are connected to one another by said connectors.

In describing the invention in detail, reference will be made to the accompanying drawings, in which:

BRIEF DESCRIPTION OF THE DRAWINGS

FIG. 4 is a perspective, partially exploded view of another preferred embodiment of an article of furniture according to the present invention.

FIG. 5 is a sectional view taken along the lines V—V of FIG. 4.

FIG. 6 is a plan view showing one configurational mode for the article of furniture of the present invention of FIG. 4.

DESCRIPTION OF THE PREFERRED EMBODIMENTS

Figure 1:
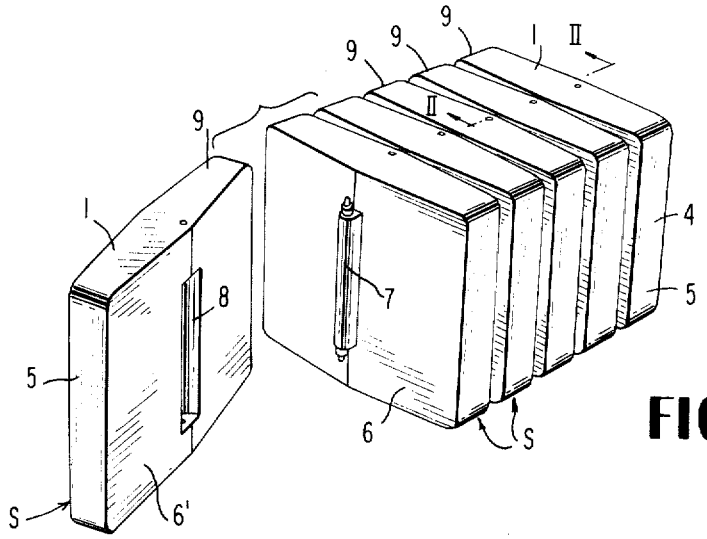
FIG. 1 is a perspective, partially exploded view of one preferred embodiment of an article of furniture according to the present invention.
Figure 2:
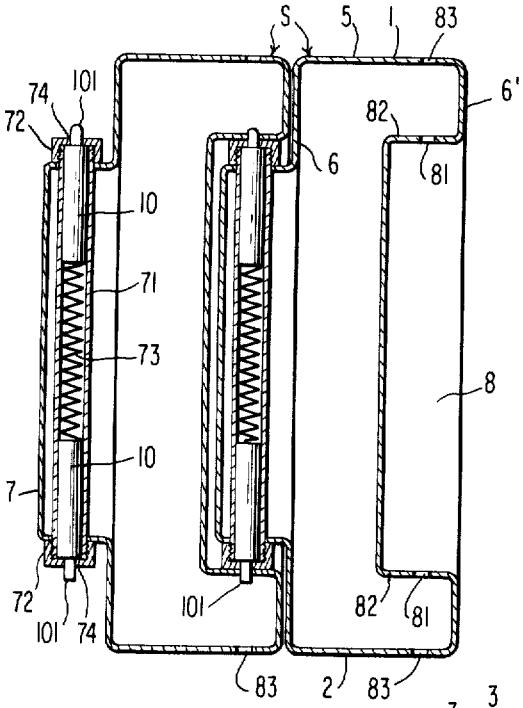
FIG. 2 is a sectional view taken along the lines II—II of the embodiment of FIG. 1.
Figure 3:
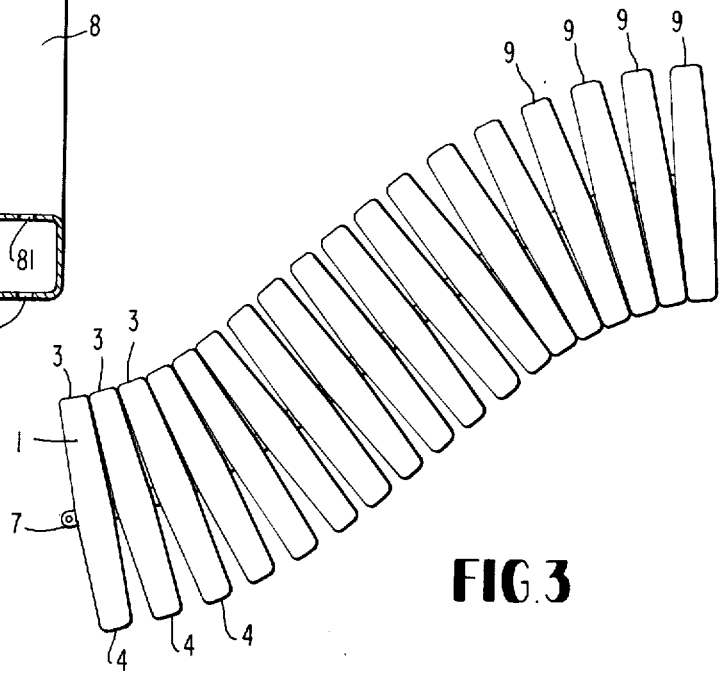
FIG. 3 is a plan view of one configurational mode of the article of furniture of the present invention of FIG. 1.

In the multiple embodiments, like elements are given like numerical designations. Turning now to FIGS. 1, 2 and 3, there is shown one embodiment of a connected chair according to the present invention.

A structural member or body comprises a pair of frame plates 1 and 2 which are oppositely disposed, said frame plates 1 and 2 being narrowed in width gradually from the central portion toward their opposite ends.

Another pair of frame plates 3 and 4 are oppositely disposed, and connected at their ends to respective plates 1 and 2, said frame plates 3 and 4 having plate surfaces of constant width over their entire length. The aforementioned frame plates 1, 2, 3 and 4 constitute, therefore, an angulated barrel-shaped frame body 5.

A pair of wall plates 6 and 6' are disposed in spaced relation and overlie the open ends of the angulated barrel-shaped frame body 5. Preferably, the wall plates 6 and 6' are integrally formed.

The structural bodies 9 are interconnected to form a given article of furniture such as the chair of FIG. 1. One form of interconnection takes the form of interlocking, male projections or connectors 7 formed at the center and on the exterior surface of the left hand wall plate 6, the male connector 7 being received within an integral elongated recess or female connector 8 within the right hand wall plate 6' of the adjacent structural body. The male projection or connector 7 comprises an internal cylindrical body 71 extending parallel to the vertical center line of left hand wall plate 6, the cylindrical body 71 slidably receiving a pair of pins or arbors 10 which are spring biased towards respective ends of the cylindrical bodies 71 by an interposed compression spring 73. Cover bodies 72 prevent the pairs of arbors 10 from slipping out of the cylindrical body 71, and in turn the cover bodies 72 are each provided with a small diameter opening 74 through which project slender tips or shafts 101 at the extremities of the arbor. The female connector 8 which takes the form of a recess within right hand side walls 6' of each structural member or body 9, may readily be formed by stamping a concave depression within wall plate 6'. Thus, the recess or female connector 8 comprises a cylindrical or arcuate recess of a width and length slightly in excess to those of projection or male connector 7, the recess including opposed end walls 82 which are provided with holes 81 to receive projecting tips or shafts 101 of arbors 10 of the next adjacent structural member. Thus, the projection connector 7 is insertably received within the female recess of female connector 8 in which case the tips or shafts 101 ride on the end walls 82 until they fall into respective holes 81. Holes 83 in the frame plates 1 and 2 permit entry of a rod to disengage the connectors.

A plurality of the structural members or bodies 9 are positioned in alignment as shown in FIG. 1, the male connectors 7 are insertably received within the female connectors 8 and the projecting tips 101 of the arbors 10 are spring biased into the openings 81 of the end walls 82 defining the concave recess or female connector and thus the structural members 9 are mechanically linked together but permitted some pivoting by rotation about the axis defined by arbors 10 and in particular the projecting tips 101 and holes 81 within the recess end walls 82.

In connecting a plurality of the structural members 9 to each other, the projecting tips 101 of the arbors in the male connectors 7 are pressed by hand such that the projecting tips 101 of the arbor are forced back into the cover bodies 72 and at the same time the projection connector 7 is inserted into the recess or female connector 8 of the next adjacent structural member 9. The arbors 10 self release to make the final connection as the tips 101 seek the aligned holes 81 at the top and bottom of the recess. The article of furniture formed by connecting a plurality of structural members 9 in the manner described above permits the assembled structural member to be used in the manner of a chair or sofa. The limited rotation of the structural members 9 on the arbors 10 in the male projection connector 7 permits the sofa to be shaped in sertpentine fashion or the sofa may take the form of a complete, interconnected ring of structural members 9.

In separating the structural members for the article of furniture, a slender rod (not shown) is inserted into the openings formed at 83 within frame plates 1 and 2 respectively to push the projected tips 101 of the arbor inwardly against the spring 73 and permit the male connector 7 to be removed from the female connector 8 in each instance.

A modified form of a furniture structure in accordance with the present invention is described with reference to FIGS. 4, 5 and 6.

In the drawing, there is shown a pair of opposed upper and lower frame plates 1 and 2 which have their surfaces narrowed in width from the center outwardly toward opposite ends. The upper and lower frame plates 1 and 2 are connected to each other by another pair of laterally opposed frame plates 3 and 4 which are of constant width over the entire length of the same. The four frame plates therefore define a rectangular, preferably square frame body 5 generally identical to the frame body 5 of the first embodiment. In like fashion, the frame body 5 has integrally formed therewith wall plates 6 on respective sides. Connectors indicated generally at 7 and 8 projected in directions opposite to one another substantially along the vertical center line of wall plate 6. In this case, the connectors 7 and 8 take the form of multiple integral U-shaped plate projection portions 7*a*, 8*a* which are alternately spaced vertically on respective sides of the structural body 9 and which are spaced from each other such that connector portions 7*a*, 8*a* on respective sides of plate 6 is interleaved. The U-shaped portions form aligned arbor insertion openings 74 for connector portions 7*a* and openings 84 for connector portions 8*a* with the structural bodies 9 assembled in the manner of FIGS. 4 and 5. Coupling is completed by passing a small diameter arbor or shaft through the interleaved U-shaped projection portions with the insertion openings 74 and 84 of respective U-shaped projections being aligned as seen in FIG. 5, the arbor 10 being of a length approximating the distance between the upper and lower frame plates 1 and 2. It is noted in this case that notches are provided as at 21 on both side edges of the upper and lower plates 1 and 2 at the center to permit the insertion and removal of the arbor 10. Preferably, stop bolts 102 are threaded to the upper and lower ends of arbor 10 so as to prevent the arbor 10 from slipping out after connection is made. Limited pivoting of the structural bodies 9 with respect to each other about the axes formed between connectors 7 and 8 is permitted in the manner of the prior embodiment to modify the configuration mode of the article of furniture during its use.

Figure 7:
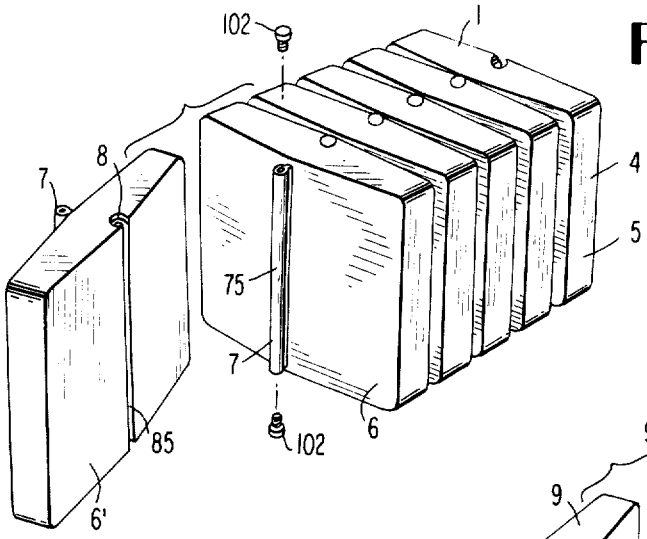
FIGS. 7, 8 and 9 are perspective, partially exploded views of further embodiments of the article of furniture according to the present invention.
Figure 8:
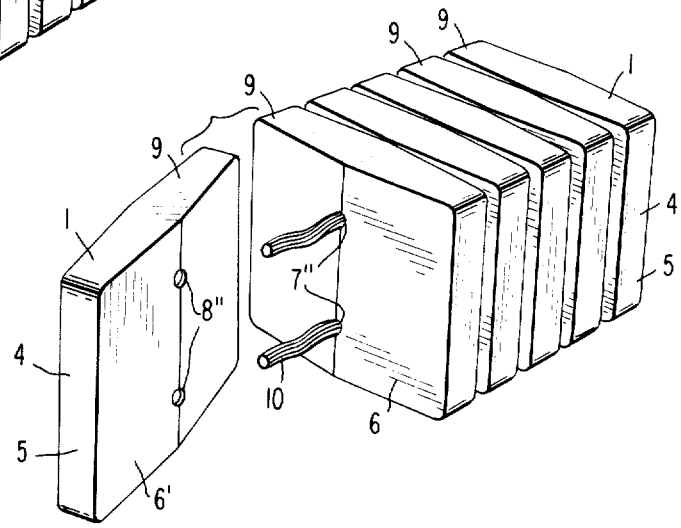

FIGS. 7 and 8 illustrate a third embodiment of the invention in somewhat modified form.

In this structural arrangement, each frame body 9 has a pair of wall plates 6 and 6' integrally formed on opposite sides thereof. However, in this case, wall plate 6 being the left hand wall plate in each instance as shown in FIG. 7 is provided with a male projection connector in alignment with the vertical center line and taking the form of a fixed, small diameter shaft 75 which may be integrally formed therewith, separated therefrom, or welded thereto as the case may be. Correspondingly, a cylindrical groove 85 is formed within the wall plate 6' of the next adjacent structural body on the center line. The cylindrical groove receiving the shaft 75 which projects slightly away from the face of wall plate 6 such that a pivotable connection is made between all of the bodies 9 in this embodiment of the invention. Again, stop bolts 102 having enlarged heads are threaded to the upper and lower ends of shaft 75 to prevent axial shifting of the shaft relative to the cylindrical slot 85 but permitting some rotation with respect thereto. This avoids vertical displacement between the interconnected structural bodies 9.

In the FIG. 8 construction, like elements are given like numerical designations, and a simplified connection arrangement is made by providing a connection arrangement consisting of one or more holes 7'' within one side wall plate as at 6 and holes of similar diameter and at similar positions on the center of the opposite plate 6' of the next adjacent structural body 9 in each instance. In this case, all of the structural bodies 9 are coupled together by means of strings 10 which are of a diameter corresponding to the diameter of holes 7'' and 8'' defining a suitable connection between the structural bodies 9 for the article of furniture. Depending upon the size of the article of furniture, the string would be larger or smaller and take the form of cord, roll or the like.

Figure 9:
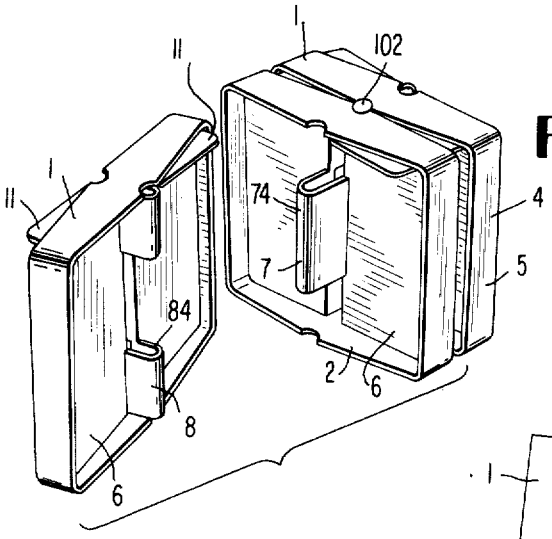
Figure 10:
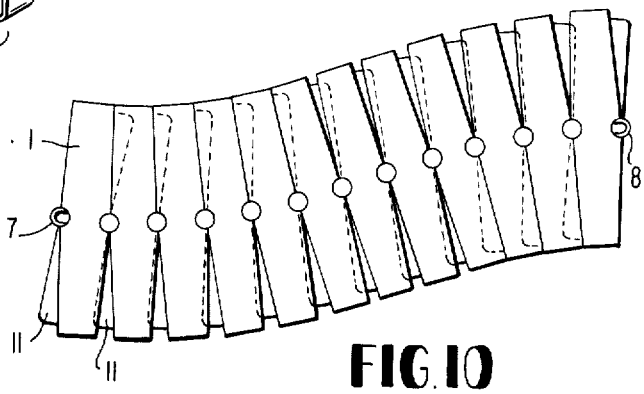
FIG. 10 is a plan view showing one configurational mode for the article of furniture of FIG. 9.

Referring next to FIGS. 9 and 10, these figures illustrate another modified form of the article of furniture in accordance with the present invention. The frame body 5 in each instance is provided with wall plate 6 which is recessed with respect to edges of the frame body 5 and further at least adjacent one of the upper or lower frame plates 1 and 2, there is provided narrow projecting plates 11 which project outwardly from the wall plate 6 on one side of the center line only of that wall and projecting outwardly from the same frame from beneath the same frame but from the opposite wall plate 6' thereof and to the opposite side of the centerwall permit as seen in FIG. 10 these projecting plates to obscure the interior and in particular the connections made between the interleaved oppositely directed integral U-shaped projection portions of connectors 7 and 8 for respective side plate 6. This concludes the study of the article of furniture, when the bodies are pivoted such that the article of furniture takes a serpentine configuration, such as that shown in FIG. 10.

The frame body and wall plate in the multiple structural members 9 forming the various embodiments of the article of furniture of the present invention are preferably of integral construction in unitary form of metal or synthetic resin by metal stamping, plastic work, molding, etc. Alternatively, the structural members or bodies 9 may in each case be formed by suitably combining wooden plates, metal plate, synthetic resin, concrete slabs, etc. Each body 9 may comprise dual wall plates 6 and 6' or may include only one such wall plate.

The article of furniture which may be made up of linking or connecting the structural members 9 may take the form of sofas, desks, beds, tables, etc. Since each of the structural bodies comprise angulated barrel shaped frame bodies, consisting of pairs of opposed frame plates having surfaces which narrow the width of the central portion of the opposite ends thereof, while the other pairs of opposed frame plates which define the rectangular frame body each have surfaces which are of constant width over their entire length and since the frame bodies include wall plates covering the open ends thereof and wherein interconnecting, cooperating connecting portions are formed substantially at the center line of the wall plates, a plurality of the thus formed structural members may be connected to one another at said central connecting portions.

Furthermore, each of the central members forming the article of furniture in accordance with the present invention is designed to be rotated on its connection portions, the furniture may take the shape of a curve, closed ring or serpentine, as shown in FIGS. 3, 6 and 10, providing a variable mode of use in terms of configuration in accordance with the exact purpose of use and comprises an improvement in esthetic and ornamental effect to articles of furniture formed thereby.

While the invention has been described in detail and with reference to specific embodiments thereof, it will be apparent to one skilled in the art that various changes and modifications can be made therein without departing from the spirit and scope thereof.

What is claimed is:

1. An article of furniture comprising:

interconnected structural bodies, each structural body including a frame body comprising a pair of identical spaced, opposed frame plates which narrow in width from the center thereof towards opposite ends, and another pair of identical, spaced, opposed frame plates whose width is constant for the entire length thereof, said pairs of frame plates being joined together at their ends to form an open hexagonal frame, at least one wall plate laterally spanning said frame body and fixed at its edges thereto, and connector means fixed to said at least one wall plate at the center thereof and extending outwardly therefrom at right angles to said wall plates for connecting said structural bodies, one to the other for limited pivoting about an axis parallel to a line passing through the center of the connecting bodies such that said frame bodies are stacked in fish bone, pivotably linked fashion.

2. The article of furniture as claimed in claim 1, wherein each frame body includes two wall plates which overlie the open ends of said frame body and said connector means comprise a male connector in the form of an integral elongated projection of one of said side wall plates at the center thereof and a corresponding female connector in the form of an integral recess within the other wall plate at the center thereof, and means for pivotably mounting said projections within recesses.

3. The article of furniture as claimed in claim 2, wherein said integral elongated projections include a cylindrical member extending longitudinally the length of the same, a pair of arbors slidably mounted within said cylindrical member, a compression spring within said cylindrical member and interposed between said arbors to bias said arbors towards opposite ends of said cylindrical member, cover plates overyling the ends of said cylindrical member, said arbors terminating in reduced diameter projecting tips and said cover plates including holes aligned with and receiving said arbor tips to permit said tips to project therethrough, and wherein said recesses are formed by opposed end walls having openings therein respectively receiving the projecting tips of said spring biased arbors of the adjacent structural body.

4. The article of furniture as claimed in claim 1, wherein said connector means comprises U-shaped connector portions extending outwardly of a given wall plate on each side of said structural body along the center line thereof in opposite directions and being alternately stacked from side to side such that connector portions on side of one body interleave connector portions on the opposing side of the next adjacent structural body and a connecting shaft extending axially through said interleaved U-shaped connector portions to form a hinge connection therebetween, permitting limited pivotable movement of one body with respect to the other about an axis parallel with the center line of said body.

5. The article of furniture as claimed in claim 4, wherein the side edges of the frame plates which narrow in width are notched at their center line to permit passage of said connecting shaft and stop bolts are threaded to respective ends of said shaft after insertion to prevent said shaft from slipping out of said interleaved U-shaped projections.

6. The article of furniture as claimed in claim 1, wherein side wall plates overlie the open ends of said frame body and are flush with the edges of said pairs of frame plates, and said connector means comprise a small diameter shaft mounted to the face of one of said wall plates in alignment with the center line of said structural body and said other wall plate comprises a cylindrical recess within the surface of the same in alignment with said shaft such that said structural bodies are intercoupled by sliding said shaft of one of said bodies into said cylindrical casing of the next adjacent body.

7. The article of furniture as claimed in claim 1, wherein said at least one wall plate for each structural body is provided with a pair of spaced openings along the center line thereof, and said structural bodies are interconnected by means of string which commonly extends through respective holes of a plurality of said structural bodies to form a string array.

8. The article of furniture as claimed in claim 4, wherein projection plates extend laterally beneath one of said frame plates which narrows in width from the center toward the opposite end, beyond the edge thereof such that upon pivoting of one interconnected structural body with respect to the other, the projection plate partially shields the gap between the structural bodies from view.

* * * * *